US010947806B2

(12) United States Patent
Johnson

(10) Patent No.: US 10,947,806 B2
(45) Date of Patent: Mar. 16, 2021

(54) SURFACE DEPLOYING SLEEVE AND PLUG LAUNCHER FOR AN OIL OR GAS WELL

(71) Applicant: STONEWALL ENERGY CORP., Red Deer (CA)

(72) Inventor: Darren Johnson, Red Deer (CA)

(73) Assignee: STONEWALL ENERGY CORP., Red Deer (CA)

( * ) Notice: Subject to any disclaimer, the term of this patent is extended or adjusted under 35 U.S.C. 154(b) by 41 days.

(21) Appl. No.: 16/196,239

(22) Filed: Nov. 20, 2018

(65) Prior Publication Data

US 2019/0153795 A1 May 23, 2019

(30) Foreign Application Priority Data

Nov. 22, 2017 (CA) ..... CA 2986325

(51) Int. Cl.

| | |
|---|---|
| ***E21B 33/068*** | (2006.01) |
| ***E21B 23/04*** | (2006.01) |
| ***E21B 33/12*** | (2006.01) |
| ***E21B 19/00*** | (2006.01) |
| *E21B 43/12* | (2006.01) |

(52) U.S. Cl.
CPC ..... *E21B 33/068* (2013.01); *E21B 19/00* (2013.01); *E21B 23/04* (2013.01); *E21B 33/12* (2013.01); *E21B 43/126* (2013.01)

(58) Field of Classification Search
CPC ..... E21B 33/068; E21B 41/00
See application file for complete search history.

(56) References Cited

U.S. PATENT DOCUMENTS

| | | | | |
|---|---|---|---|---|
| 6,039,122 | A * | 3/2000 | Gonzalez | E21B 33/068 166/379 |
| 6,269,875 | B1 * | 8/2001 | Harrison, III | E21B 33/068 166/53 |
| 6,637,512 | B2 * | 10/2003 | Casey | E21B 33/068 166/310 |
| 9,103,183 | B2 * | 8/2015 | He | E21B 33/068 |
| 9,115,562 | B2 * | 8/2015 | Guidry | E21B 43/26 |
| 2008/0053650 | A1 * | 3/2008 | Hovelkamp | E21B 33/068 166/75.15 |
| 2016/0047185 | A1 * | 2/2016 | Luharuka | E21B 21/062 166/250.01 |
| 2017/0022777 | A1 * | 1/2017 | Allen | E21B 34/02 |
| 2018/0002999 | A1 * | 1/2018 | Johnson | E21B 33/068 |

* cited by examiner

*Primary Examiner* — Robert E Fuller
(74) *Attorney, Agent, or Firm* — King & Schickli, PLLC

(57) ABSTRACT

A sleeve and plug launcher for launching a sleeve and plug down an oil or gas well includes sleeve and plug holders, a support plate beneath the open bottoms of the sleeve and plug holders, an aperture positioned in the support plate and a sleeve and plug discharge connectable to a well head of a well and positioned below the aperture. When one of the sleeve and plug holders stops over the aperture in the support plate, a sleeve and plug in the sleeve and plug holders drops through the aperture and is directed into a wellhead by the sleeve and plug discharge.

19 Claims, 7 Drawing Sheets

SURFACE DEPLOYING SLEEVE AND PLUG LAUNCHER FOR AN OIL OR GAS WELL

The present invention relates to sleeve and plug launcher for launching an elongate cylindrical sleeve containing an internally displaceable plug down an oil or gas well and more particularly to a launcher that can launch a plurality of cylindrical sleeves containing internal plugs in series when desired down the well.

BACKGROUND

After an oil and gas is drilled through an underground reservoir, it is now common to stimulate zones of interest along the well by fracturing. This is accomplished by the zone of interest along the well first being "isolated" (sealed off from the rest of the well) and then a fracturing fluid is typically pumped down hole to this isolated zone of interest under high pressure. The highly pressurized fracturing fluid is allowed to gain access to the well bore in the zone of interest to create cracks in the formation the zone of interest passes through so that oil or gas will flow more freely through these cracks in the formation. Commonly, when the fracturing fluid is removed from the well, proppants are used to keep the cracks in the formation that have been formed by the fracturing open.

It is common for there to be a number of "zones of interest" to be identified along the length of the well and fracturing to be performed on each zone of interest. However, in order to isolate each zone, some sort of device must be used to allow each zone of interest to be separately isolated in order to fracture each separate zone of interest.

Previously multi-stage ball drop fracturing systems were used to isolate each zone of interest. These systems use balls of different sizes to allow each zone of interest to be isolated and fractured, with the balls getting progressively larger in diameter as you move back upstream along the well. However, these systems require passages of decreasing size along the length of the well for the different size balls to be used. This required decrease in inner diameter can undesirably restrict flow fluid through the liner when the fracturing fluid is pumped down the well to stimulate a zone of interest and cause pressure drops in the fracturing fluid, making the fracturing process less efficient. Additionally, if these restrictions remain after the fracturing process is completed, they can also restrict the production of oil or gas from the well. These systems also typically require milling out of components at each section that was isolated before the well could be used for production.

To avoid these problems, it is now becoming common to use a cylindrical or elongate sleeve (sometimes referred to as a collet) with an internally displaceable plug (often in the form of a ball) positioned within the sleeve instead of just using balls alone to isolate the different zones of interest in a well. The sleeve (or collet) is cylindrical shaped with an interior passage running inside along the length of the sleeve. The plug or ball is provided inside this interior passage in the sleeve and is used to block the flow of fluid through the well. The sleeve and plug are designed to work with a section of tubing liner which can be run in downhole to the desired location. When fracturing is to be done, the sleeve and plug can be forced down to the well to the section of tubing liner where the sleeve will be lodged in place with a mated sleeve in the section of tubing liner. Once the sleeve is lodged in place downhole in the mated sleeve, the plug creates a seal and the increase in pumping pressure opens the sleeve in the section of liner which will allow pressurized fracturing fluid to come into contact with the well bore for stimulating it. Commonly, the plug is designed so that it will dissolve over time after it has come into contact with liquid in the well. Because the plug dissolves and opens up the interior passage of the sleeve, all of the sleeves can be provided with a similar inner diameter for these passages, preventing the problem caused by using plugs alone where the plugs and interior passages have be continually decreasing inner diameters in order to work.

However, while these sleeves and plugs work well for isolating zones of interest in the well, they must be launched down the well from the surface through the well head and it would be desirable to be able to launch a number of them in series and in a controlled fashion to allow a number of zones to be isolated with a number of sleeves and plugs.

SUMMARY

A surface deploying frac sleeve shifter/positioner launcher for launching a sleeve with an internal plug down a well is provided.

In a first aspect, a sleeve and plug launcher is provided. The sleeve and plug launcher can have a plurality of sleeve and plug holders, each sleeve and plug holder comprising an open top and an open bottom and configured to hold a sleeve and plug, a support plate provided beneath the open bottoms of the sleeve and plug holders, the support plate providing a support surface for sleeves and plugs positioned in the plurality of sleeve and plug holders, a sprocket positioned above the support plate and relative to the plurality of sleeve and plug holders, the sprocket rotatable relative to the support plate and operative to rotate the plurality of sleeve and plug holders along a travel path around the support plate, a sleeve and plug discharge connectable to a well head of a well and having an aperture sized to allow a collet to pass through the aperture, the aperture provided in the support plate along the travel path so that each of the plurality of sleeve and plug holders passes over the aperture as the plurality of sleeve and plug holders follow the travel path around the support plate, a motor operatively connected to the sprocket to rotate the sprocket and the plurality of the sleeve and plug sleeves relative to the support plate and a stop operatively connected to the motor, the stop operative to stop the motor when one of the plurality of sleeve and plug holders is positioned over the aperture. When one of the sleeve and plug holders stops over the aperture in the support plate, a sleeve and plug in the one of the sleeve and plug holders drops out of the one of the sleeve and plug holders through the aperture and is directed into a wellhead by the sleeve and plug discharge.

In a first aspect, a further sleeve and plug launcher is provided. The sleeve and plug launcher can include a plurality of cylindrical sleeve and plug holders, each sleeve and plug holder comprising an open top, an open bottom and cylindrical shaped interior configured to hold a sleeve and plug, a support plate provided beneath the open bottoms of the sleeve and plug holders, the support plate providing a support surface for sleeves and plugs positioned in the plurality of sleeve and plug holders, a sprocket positioned above the support plate and relative to the plurality of sleeve and plug holders, the sprocket rotatable relative to the support plate and operative to rotate the plurality of sleeve and plug holders along a travel path around the support plate, the sprocket comprising a series of semi-circular concave indentions around a circumference of the sprocket, each concave indentation having a radius of curvature that is substantially the same as an outside surface of each sleeve and plug holder, each sleeve and plug holder of the plurality of sleeve and plug holders attached to the sprocket in one of the concave indentations, a chain ring provided between the sprocket and the support plate, the chain ring operatively secured to the sprocket and rotatable relative to the support plate, a drive sprocket, a chain provided between the drive sprocket and the chain ring to transfer rotational motional of the drive sprocket to the chain ring, a sleeve and plug discharge connectable to a well head of a well and having an aperture sized to allow a sleeve and plug to pass through the aperture, the aperture provided in the support plate along the travel path so that each of the plurality of sleeve and plug holders passes over the aperture as the plurality of sleeve and plug holders follow the travel path around the support plate, a motor operatively connected to the drive sprocket whereby rotation of the motor rotates the drive sprocket, and a stop operatively connected to the motor, the stop stopping the motor when one of the sleeve and plug holders is positioned over the aperture. When one of the sleeve and plug holders stops over the aperture in the support plate, a sleeve and plug in the one of the sleeve and plug holders drops out of the one of the sleeve and plug holders through the aperture and is directed into a wellhead by the sleeve and plug discharge.

DESCRIPTION OF THE DRAWINGS

A preferred embodiment of the present invention is described below with reference to the accompanying drawings, in which.

DETAILED DESCRIPTION OF THE ILLUSTRATED EMBODIMENTS

Figure 1:
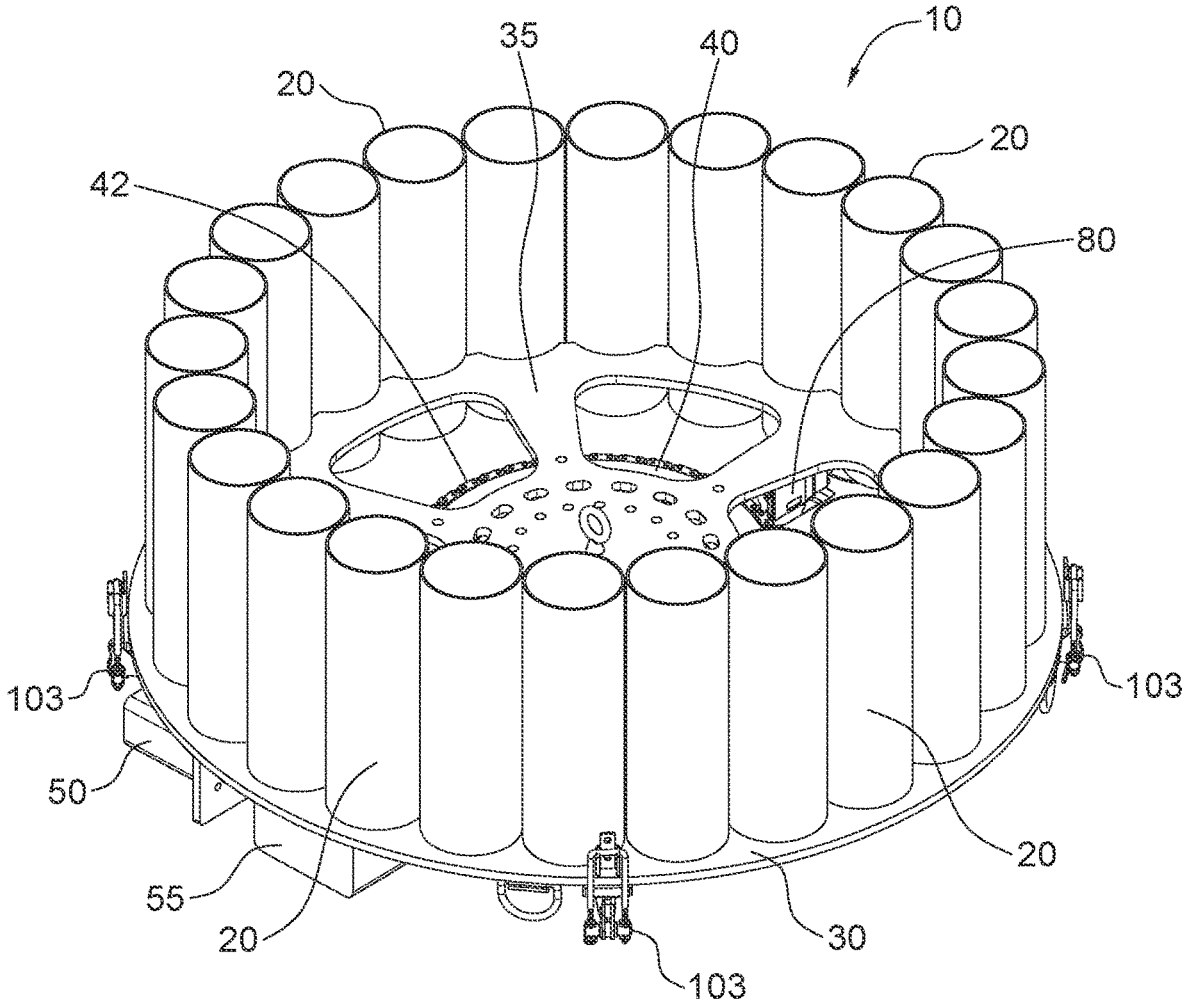
FIG. 1 is a perspective view of a sleeve and plug launcher.
Figure 2:
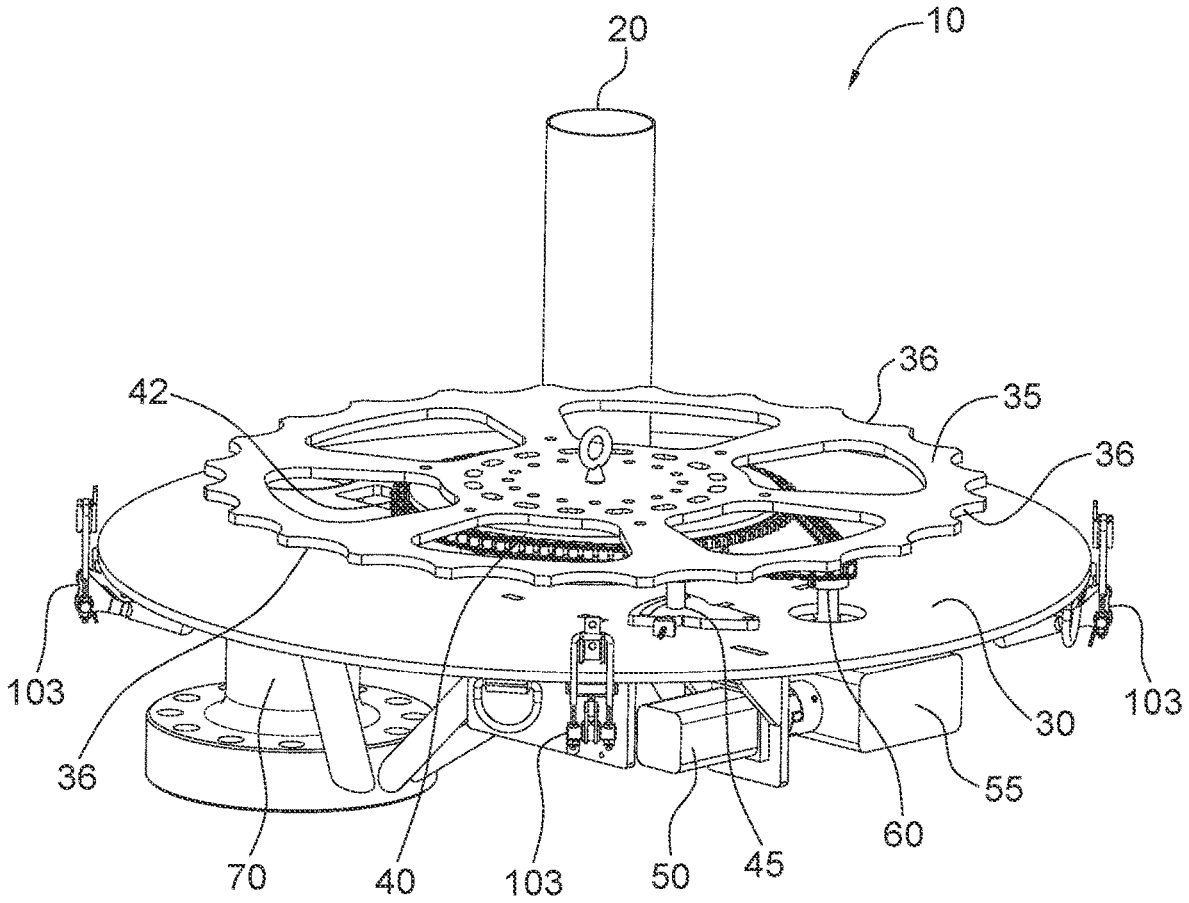
FIG. 2 is a partial view of the sleeve and plug launcher showing some of the inner components of the sleeve and plug launcher.
Figure 3:
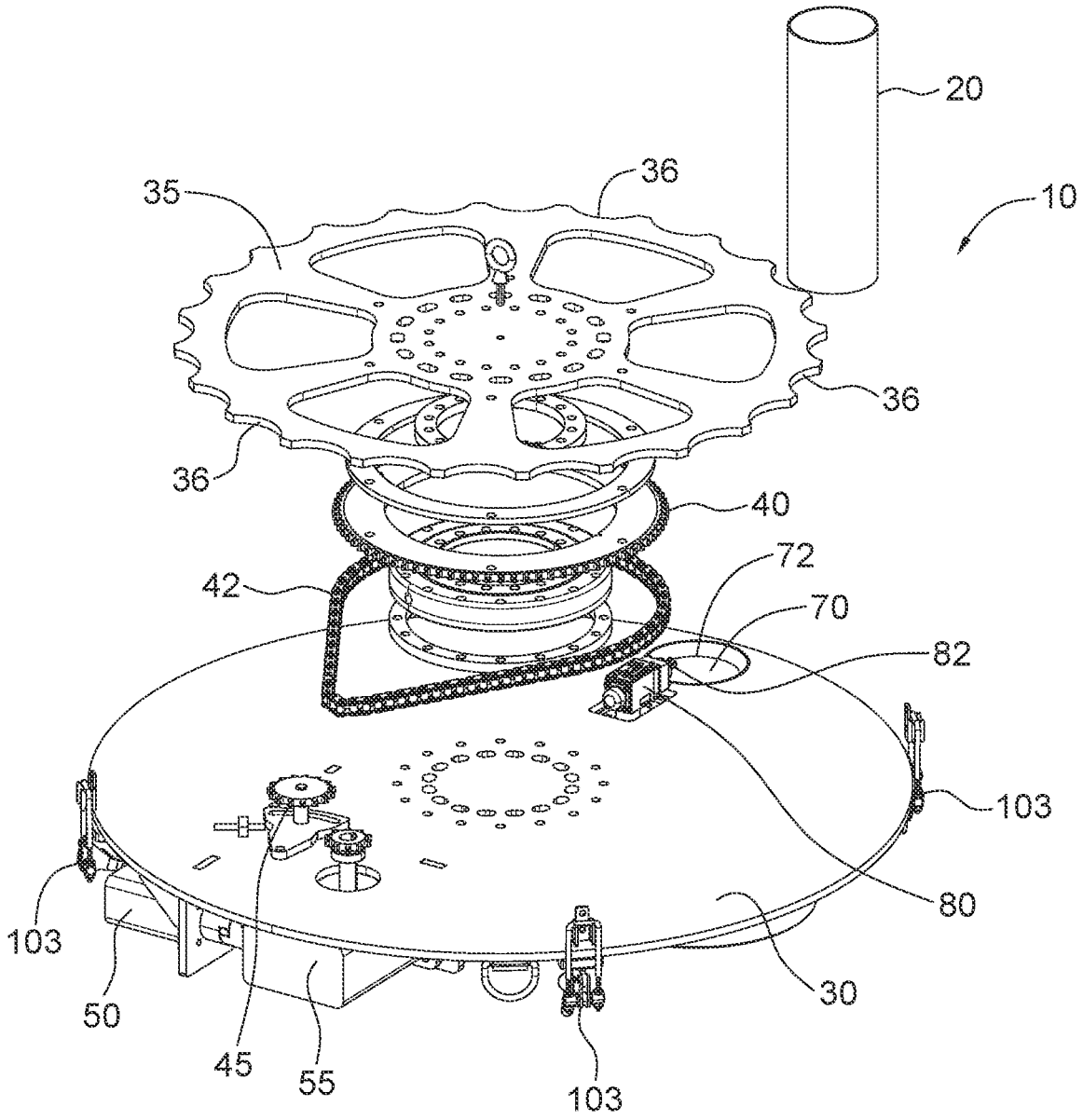
FIG. 3 is an exploded view of the sleeve and plug launcher.
Figure 4:
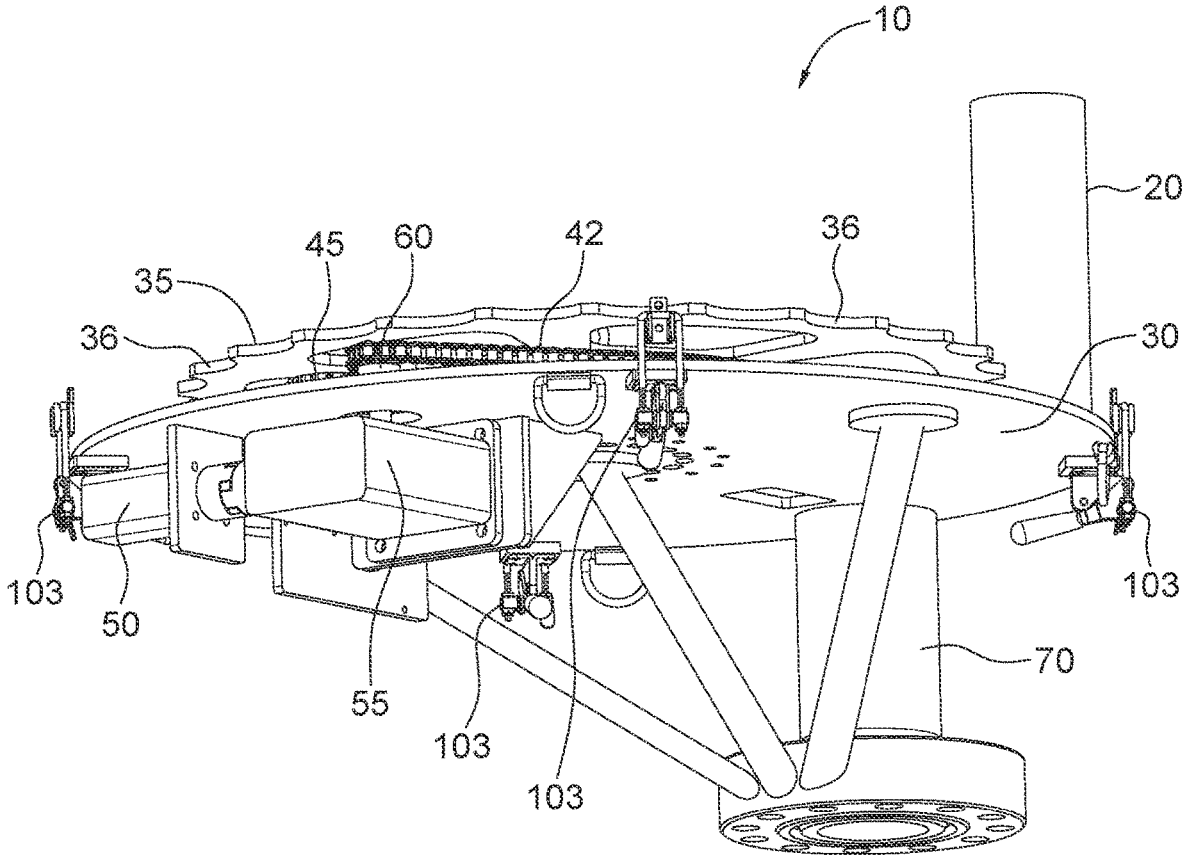
FIG. 4 is an bottom partial perspective view of the sleeve and plug launcher.

FIGS. 1-4 illustrate a sleeve and plug launcher 10 to be installed at the top of a well head for launching sleeves containing plugs down a well. The sleeve and plug launcher 10 can include a number of cylindrical sleeve and plug holders 20, each of the sleeve and plug holders 20 capable of holding a sleeve and plug (not shown) until the sleeve and plug is ready to be released down a well by the sleeve and plug launcher 10. Each of the sleeves can have an elongate, cylindrical shape and contain an internal plug (in some cases a ball), that can be displaced inside the sleeve to stop fluid flowing through the sleeve.

The sleeve and plug launcher 10 can include: a plurality of sleeve and plug holders 20; a support plate 30; a sprocket 35; a chain ring 40; a chain 42; a chain tensioner 45; a hydraulic motor 50; a gear box 55; a drive sprocket 60; a sleeve and plug discharge 70; and a stop 80.

The sleeve and plug holders 20 can each be cylindrical in shape with an open top and an open bottom. The sleeve and plug holders 20 can have a cylindrical interior that is sized to house a sleeve and plug. A sleeve and plug can be loaded into an open top of the sleeve and plug holder 20 so that the sleeve and plug is held in place in the sleeve and plug holder 20 until it gets discharged out the sleeve and plug discharge 70.

Figure 5:
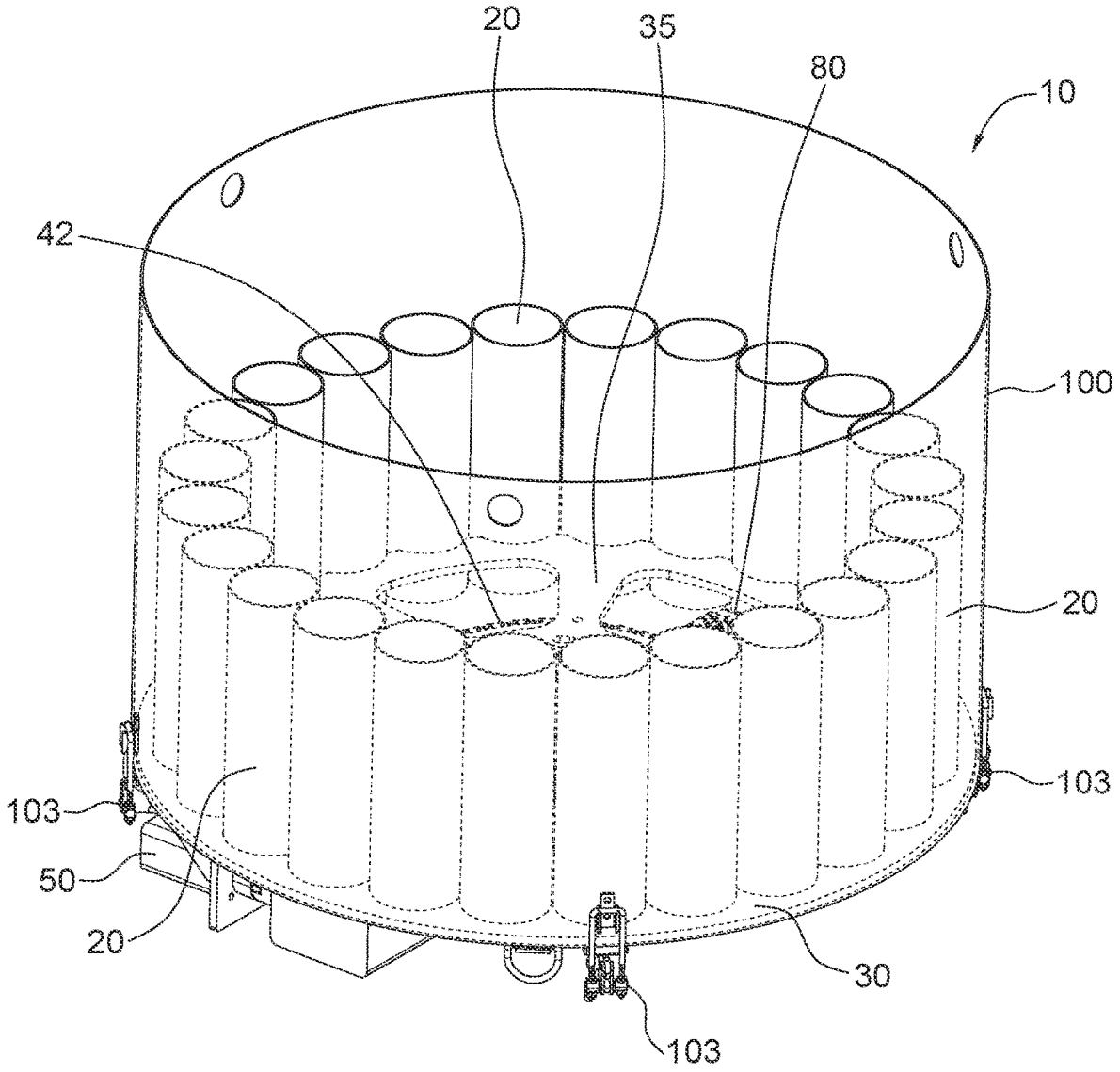
FIG. 5 is a perspective view of the sleeve and plug launcher with a cover.
Figure 6:
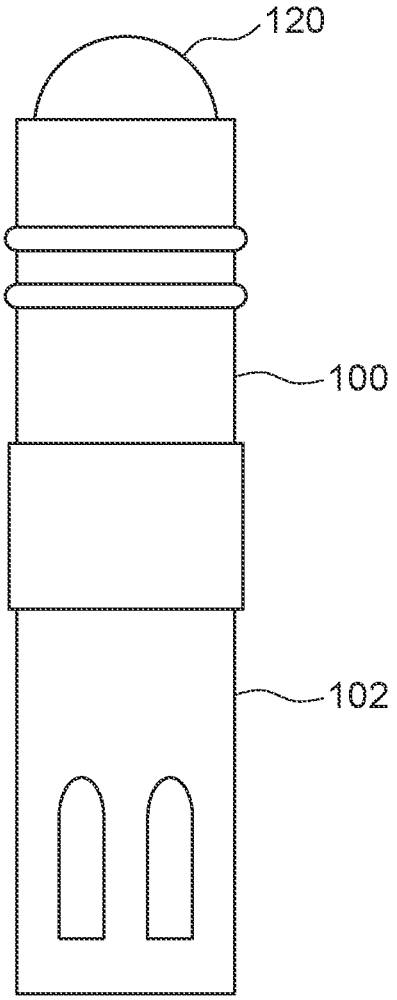
FIG. 6 is a side view of a sleeve and plug.
Figure 7:
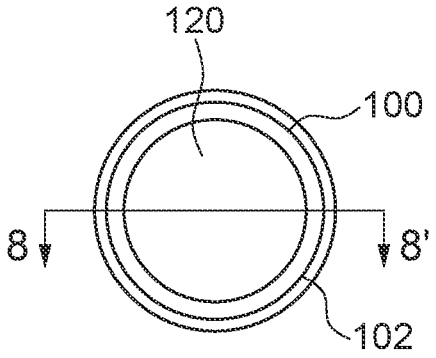
FIG. 7 is a top view of the sleeve and the plug in FIG. 6.
Figure 8:
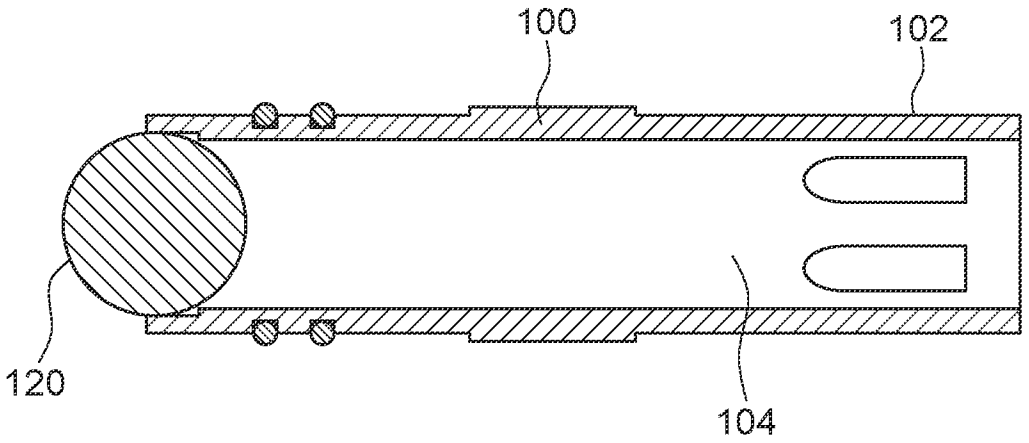
FIG. 8 is a side sectional view of the sleeve and the plug along section line 8-8' shown in FIG. 7.

FIGS. 6-8 illustrate a sleeve 100 and plug 120 that can be launched down a well using the sleeve and plug launcher 10 shown in FIGS. 1-5. In the embodiment shown in FIGS. 6-8, the sleeve 100 can have a cylindrical body 102 with an interior passage 104 passing through the cylindrical body 102. The plug 120 shown in FIGS. 6-8 is spherical and sized to be held inside the interior passage 104 running through the cylindrical body 102 of the sleeve 100 at a top of sleeve 100.

For example, the sleeve 100 and the plug 120 can be used for fracturing. When fracturing is to be done in a well, the sleeve 100 and plug 120 can be forced down the well to a section of tubing liner where the sleeve 100 will be lodged in place with a mated sleeve in the section of tubing liner. Once the sleeve 100 is lodged in place downhole in the mated sleeve, the plug 120 can create a seal and the increase in pumping pressure opens the sleeve in the section of liner which will allow pressurized fracturing fluid to come into contact with the well bore for stimulating it. The plug 120 can be designed so that it will dissolve over time after it has come into contact with liquid in the well. Once the plug 120 has dissolved, the interior passage 104 well be unblocked and fluid can through the sleeve 100 through the interior passage 104.

Referring again to FIGS. 1-4, the support plate 30 forms a support surface for the sleeve and plug holders 20 and sleeves and plugs placed in the sleeve and plug holders 20.

The sprocket 35 can have a series of semi-circular concave indentations 36 around the circumference of the sprocket 35. The concave indentations 36 can have a radius of curvature that matches a radius to an outside surface of the sleeve and plug holders 20 so that the sleeve and plug holders 20 can be partially inserted into the concave indentations 36 and attached to the sprocket 35 in these concave indentations 36.

The sprocket 35 can rotate relative to the support plate 30 so that the sprocket 35 and the plurality of sleeve and plug holders 20 provided in the concave indentations 36 of the sprocket 35 can rotate while the support plate 30 remains stationary. This rotation of the sprocket 35 and the plurality of sleeve and plug holders 20 relative to the support plate 30 can cause the plurality of sleeve and plug holders 20 to follow a travel path along a surface of the support plate 30 with the travel path of the sleeve and plug holders 20 defining a circular path over the support plate 30.

The chain ring 40 can be provided between the sprocket 35 and the support plate 30 with the chain ring 40 operatively secured to the sprocket 35 and rotatable relative to the support plate 30 so that rotation of the chain ring 40 will thereby rotate the sprocket 35 and in turn the plurality of sleeve and plug holders 20 connected to the sprocket 35 while the support plate 30 remain fixed in place.

The hydraulic motor 50 can be provided and connected to the gear box 55 which in turn is connected to the drive sprocket 60. Rotation created by the hydraulic motor 50 is routed through the gear box 55 to rotate the drive sprocket 60.

A chain 42 can be used to connect the drive sprocket 60 and the chain ring 40, with the chain tensioner 45 used to maintain tension on the chain 42. The chain 42 can operatively connect the drive sprocket 60 and the chain ring 40 so that when the drive sprocket 60 is rotated by the hydraulic motor 50, the rotational motion of the drive sprocket 60 will be transmitted to the chain ring 40 by the chain 42 and cause the chain ring 40 to rotate.

The sleeve and plug discharge 70 can be provided to discharge a sleeve and plug from a sleeve and plug holder 20 and into the well. The sleeve and plug discharge 70 can include an aperture 72, shown in FIG. 3, in the support plate 30 that is sized so that a sleeve and plug can pass through the aperture 72, through the sleeve and plug discharge 70 and into a well. The aperture 72 can be positioned in the support plate 30 so that it is positioned in the travel path of the sleeve and plug sleeves 20 that are attached to and rotating around the chain ring 40. In this manner, each sleeve and plug sleeve 20 will eventually pass over the aperture 72 as the chain ring 40 does one full rotation around the support plate 30.

The stop 80 can be used to stop each sleeve and plug holder 20 over the aperture 72 in the support plate 30 so that a sleeve and plug in the sleeve and plug holder 20 can drop through the aperture 72 and be directed into the well by the sleeve and plug discharge 70. The stop 80 can be a hydraulic stop valve with the stop 80 being positioned so that a contact switch 82 comes in contact with a sleeve and plug holder 20 when the sleeve and plug holder 20 passes in front from the stop 80. The passing in front of the stop 80 will cause the sleeve and plug holder 20 to depress the contact switch 82 on the stop 80 which will cause the stop 80 to stop the flow of hydraulic fluid to the motor 50 stopping the rotation of the sprocket 35 and the sleeve and plug sleeves 20. One of the sleeve and plug sleeves 20 will be positioned over the sleeve and plug discharge 70 when the sprocket 35 is stopped.

Referring to FIG. 5, a cover 100 can be provided to cover the sleeve and plug launcher 10 and specifically the plurality of sleeve and plug holders 20 and then removed to load sleeves and plugs into the sleeve and plug holders 20. In one aspect, the cover 100 can be made of see-through (transparent) polycarbonate such as Lexan™ so that an operator can see through the cover 100 and watch the operation of the sleeve and plug launcher 10. A plurality of clamps 103 can be used to secure the cover 100 to the sleeve and plug launcher 10.

In operation, the sleeve and plug launcher 10 can be installed at the top of a well head for launching sleeves containing plugs down a well. The cover 100 can be removed from the sleeve and plug launcher 10 exposing the sleeve and plug holders 20 and the desired amount of sleeves and plugs can be loaded into the sleeve and plug holders 20.

Typically, an operator will start loading sleeves and plugs in the sleeve and plug holder 20 positioned adjacent to the collet discharge and then start loading sleeves and plugs in sleeve and plug holders 20 moving in a direction opposite to the direction the sprocket and sleeve and plug holders 20 will rotate when the motor 50 is turning. With the desired number of sleeves and plugs loaded in the sleeve and plug holders 20, the cover 100 can be placed back on the sleeve and plug launcher 10.

When it is desired to launch a sleeve and plug down the well, an operator can engage the motor 50, typically by engaging a switch to route hydraulic fluid to the motor 50, which will cause the motor 50 to turn, rotating the gear box 55 and thereby rotating the drive sprocket 60. The rotating drive sprocket 60 will drive a chain which in turn will rotate the chain ring 40 and the sprocket 35.

As the sprocket 35 rotates, the next adjacent sleeve and plug holder 20 will rotate towards the sleeve and plug discharge 70 until the adjacent sleeve and plug holder 20 is positioned over the sleeve and plug discharge 70. The stop 80 will have its contact switch 82 depressed by the next sleeve and plug holder 20 which will stop the flow of hydraulic fluid to the motor 50, stopping the motor 50 from turning and thereby stopping the rotation of the sprocket 35 with the one sleeve and plug holder 20 positioned over the sleeve and plug discharge 70, allowing a sleeve and plug in the sleeve and plug holder 20 to drop into the sleeve and plug discharge 70 and down into the well.

When the next sleeve and plug is ready to be launched downhole, the operator can once again engage the switch which will once again cause the motor 50 to turn, rotating the sprocket 35 and the sleeve and plug holders 20 until the next sleeve and plug holder 20 is positioned over the sleeve and plug discharge 70. At this point, the next sleeve and plug holder 20 will have depressed the contact switch 82 on the stop 80, stopping the sleeve and plug holder 20 over the sleeve and plug launcher 10 and causing the sleeve and plug in the sleeve and plug holder 20 positioned over the aperture 72 in the sleeve and plug discharge 70 to drop into the sleeve and plug discharge 70 and thereby be directed into the well.

In this manner, each time an operator wants to launch another sleeve and plug down the well, the switch can be engaged, rotating the next sleeve and plug holder 20 holding a sleeve and plug over the sleeve and plug discharge 70 where the sleeve and plug will then drop out of the sleeve and plug holder 20, through the sleeve and plug discharge 70 and into the well.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

The invention claimed is:

1. A sleeve and plug launcher comprising:

a plurality of sleeves, each sleeve having a cylindrical body and an interior passage passing through the cylindrical body;

a plug held in the interior passage of each sleeve;

a plurality of sleeve and plug holders, each sleeve and plug holder comprising an open top and an open bottom and configured to hold one of the sleeves;

a support plate provided beneath the open bottoms of the sleeve and plug holders, the support plate providing a support surface for the plurality of sleeves positioned in the plurality of sleeve and plug holders;

a sprocket positioned above the support plate, the sprocket rotatable relative to the support plate and operative to rotate the plurality of sleeve and plug holders along a travel path around the support plate;

a sleeve and plug discharge connectable to a well head of a well and having an aperture sized to allow a sleeve and plug to pass through the aperture, the aperture provided in the support plate along the travel path so that each of the plurality of sleeve and plug holders passes over the aperture as the plurality of sleeve and plug holders follow the travel path around the support plate;

a motor operatively connected to the sprocket to rotate the sprocket and the plurality of the sleeve and plug holders relative to the support plate; and a stop operatively connected to the motor, the stop operative to stop the motor when one of the plurality of sleeve and plug holders is positioned over the aperture, whereby when one of the sleeve and plug holders stops over the aperture in the support plate, a sleeve and plug in the one of the sleeve and plug holders drops out of the one of the sleeve and plug holders through the aperture and is directed into a wellhead by the sleeve and plug discharge.

2. The sleeve and plug launcher of claim 1 wherein each sleeve and plug holder is cylindrical in shape.

3. The sleeve and plug launcher of claim 1 wherein each sleeve and plug holder has a cylindrical interior sized to hold a sleeve and plug.

4. The sleeve and plug launcher of claim 1 wherein the sprocket comprises a series of semi-circular concave indentions around a circumference of the sprocket, each concave indentation having a radius of curvature that is substantially the same as an outside surface of each sleeve and plug holder.

5. The sleeve and plug launcher of claim 4 wherein each sleeve and plug holder is attached to the sprocket in one of the concave indentations.

6. The sleeve and plug launcher of claim 1 wherein the motor is a hydraulic motor.

7. The sleeve and plug launcher of claim 6 wherein the stop comprises: a hydraulic stop valve operative to stop a flow of hydraulic fluid to the motor; and a contact switch positioned to come into contact with one of the sleeve and plug holders when the one of the sleeve and plug holders is positioned over the aperture in the support plate.

8. The sleeve and plug launcher of claim 1 further comprising a removable cover positionable over the plurality of sleeve and plug holders.

9. The sleeve and plug launcher of claim 8 wherein the cover is formed of a transparent material.

10. The sleeve and plug launcher of claim 1 further comprising: a chain ring provided between the sprocket and the support plate, the chain ring operatively secured to the sprocket and rotatable relative to the support plate; a drive sprocket operatively connected to the motor; and a chain provided between the drive sprocket and the chain ring to transfer rotational motion of the drive sprocket to the chain ring.

11. The sleeve and plug launcher of claim 10 further comprising a chain tensioner to maintain tension on the chain.

12. The sleeve and plug launcher of claim 10 further comprising a gear box operatively connecting the motor and the drive sprocket.

13. The sleeve and plug launcher of claim 1 wherein the travel path followed by the plurality of sleeve and plug holders over the support plate is a circular path.

14. A sleeve and plug launcher comprising:

a plurality of cylindrical sleeve and plug holders, each sleeve and plug holder comprising an open top, an open bottom and a cylindrical shaped interior configured to hold a sleeve and plug;

a support plate provided beneath the open bottoms of the sleeve and plug holders, the support plate providing a support surface for sleeves and plugs positioned in the plurality of sleeve and plug holders;

a sprocket positioned above the support plate, the sprocket rotatable relative to the support plate and operative to rotate the plurality of sleeve and plug holders along a travel path around the support plate, the sprocket comprising a series of semi-circular concave indentions around a circumference of the sprocket, each concave indentation having a radius of curvature that is substantially the same as an outside surface of each sleeve and plug holder, each sleeve and plug holder of the plurality of sleeve and plug holders attached to the sprocket in one of the concave indentations;

a chain ring provided between the sprocket and the support plate, the chain ring operatively secured to the sprocket and rotatable relative to the support plate; a drive sprocket;

a chain provided between the drive sprocket and the chain ring to transfer rotational motion of the drive sprocket to the chain ring;

a sleeve and plug discharge connectable to a well head of a well and having an aperture sized to allow a sleeve and plug to pass through the aperture, the aperture provided in the support plate along the travel path so that each of the plurality of sleeve and plug holders passes over the aperture as the plurality of sleeve and plug holders follow the travel path around the support plate;

a motor operatively connected to the drive sprocket whereby rotation of the motor rotates the drive sprocket;

a stop operatively connected to the motor, the stop stopping the motor when one of the sleeve and plug holders is positioned over the aperture, whereby when one of the sleeve and plug holders stops over the aperture in the support plate, a sleeve and plug in the one of the sleeve and plug holders drops out of the one of the sleeve and plug holders through the aperture and is directed into a wellhead by the sleeve and plug discharge.

15. The sleeve and plug launcher of claim 14 wherein the motor is a hydraulic motor.

16. The sleeve and plug launcher of claim 15 wherein the stop comprises: a hydraulic stop valve operative to stop a flow of hydraulic fluid to the motor; and a contact switch positioned to come into contact with one of the collet holder sleeves when one of the collet holder sleeves is positioned over the aperture in the support plate.

17. The sleeve and plug launcher of claim 16 wherein the contact switch is positioned to contact a sleeve and plug holder positioned over the aperture.

18. The sleeve and plug launcher of claim 14 further comprising a removable cover positionable over the plurality of sleeve and plug holders.

19. The sleeve and plug launcher of claim 14 further comprising a gear box operatively connecting the motor and the drive sprocket.

* * * * *